US006279770B1

(12) United States Patent
Osbakk et al.

(10) Patent No.: US 6,279,770 B1
(45) Date of Patent: Aug. 28, 2001

(54) SYSTEM FOR HANDLING AND TRANSPORTATION OF BOTTLES

(76) Inventors: Georg Osbakk, c/o Tandbergs Patentkontor A/S, P.O. Box 7085; Bjarne Lerum, c/o Tandbergs Pantkontor A/S, P.O. Box 7085, both of Oslo (NO), N-0306

( * ) Notice: Subject to any disclaimer, the term of this patent is extended or adjusted under 35 U.S.C. 154(b) by 0 days.

(21) Appl. No.: 08/809,380

(22) PCT Filed: Sep. 8, 1995

(86) PCT No.: PCT/NO95/00156

§ 371 Date: Jun. 26, 1997

§ 102(e) Date: Jun. 26, 1997

(87) PCT Pub. No.: WO96/09220

PCT Pub. Date: Mar. 28, 1996

(30) Foreign Application Priority Data

Sep. 23, 1994 (NO) ..... 943556
Mar. 13, 1995 (NO) ..... 950961

(51) Int. Cl.[7] ..... B65D 71/00
(52) U.S. Cl. ..... 220/519; 220/513; 206/501
(58) Field of Search ..... 206/501; 220/513, 220/519

(56) References Cited

U.S. PATENT DOCUMENTS 4,848,573 * 7/1989 Salacuse ..... 220/519 X
5,038,961 * 8/1991 Watanabe et al. ..... 220/519
5,263,605 * 11/1993 Caton ..... 220/519
5,335,814 * 8/1994 Hepp ..... 220/519 X
5,360,112 * 11/1994 Beauchamp ..... 220/519 X
5,377,863 * 1/1995 Oakes et al. ..... 220/513
5,673,792 * 10/1997 Aikio ..... 220/519 X

FOREIGN PATENT DOCUMENTS 0 521 705 A1 1/1993 (EP) .
82/00989 A1 4/1982 (WO) .
82/01536 A1 5/1982 (WO) .
94/07758 A1 4/1994 (WO) .

* cited by examiner

*Primary Examiner*—Steven M. Pollard
(74) *Attorney, Agent, or Firm*—Heller Ehrman White & McAuliffe

(57) ABSTRACT

A tray adapted to rest on bottles and also to receive bottles in cups in the upper side of the tray, several trays adapted to be stacked with intermediate trays, each cup thereby comprising a central flange ring having a vertical flange, the lower edge of which being adapted to rest on the supporter ring on a bottle standing on a lower tray, in such a way that the weight of the tray above, including bottles, is transferred to the bottles standing in a lower tray and further to this tray through the supporter ring.

2 Claims, 2 Drawing Sheets

SYSTEM FOR HANDLING AND TRANSPORTATION OF BOTTLES

Figure 1:
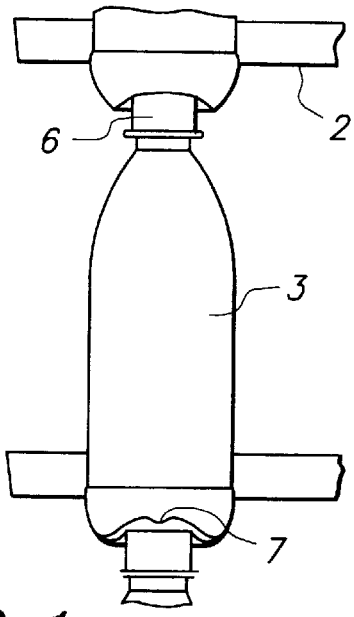

The present invention is related to a tray adapted to rest on bottles and also to receive bottles to a stack of bottles with intermediate trays.

Bottles containing mineral water or such traditionally have been sent out to retail shops in cases or boxes which had to be returned, empty or with empty bottles. Such boxes thoroughly have been used and initially were designed to protect bottles of glass. With the change to bottles of plastics, boxes have been used based on the same principle even if the purpose of the boxes, namely to protect bottles, now is made in quite another way as opposed to earlier, concerning transportation and storing at retail as well as wholesale dealers.

When disposal bottles of plastic are sent out, especially where a system of bottle deposit exists for such bottles, there exists a need for new solutions to replace the earlier type of boxes for bottles. Such boxes are transported out to the whole sale dealer and to the retailer with filled bottles, however are returned as empty boxes, thereby claiming unnecessarily large volume in relation to weight and function. The bottles of plastic as such are packed together on site and returned as a bulk.

Therefore there exists a need to provide packings adapted for recycling, which assumes substantially less space without bottles than with bottles, which certainly will be of importance as to storing and transportation for recycling.

Tests have been made to send out the bottles arranged on flat disposal trace may of cardboard or such, it has however shown that the stability is too poor with longer transportations. Likewise it has shown that costs for the retailers are too high to get rid of the disposable packaging. Here are included fees for delivering waste, cardboard, disposable package etc to official deposits.

Attempts have been made to produce trace of plastics with where the bottles are stacked in a pattern and the top of the bottles are extending a certain height up adjacent or between bottles in the layer above. This as such provides good stability, but the area used on pallets has too poor utilization. Using a Europe pallet there only will be possible to place 88 standard bottles of 1,5 1 with a diameter of 94 mm in each row. Such a solution furthermore is difficult to handle as the trace must be turned around 180° each time a new tray is placed on a row to stack a new layer in the height.

It is known to stack bottles standing on each other with a tray in between where the tray comprises upwardly protruding cups to receive the bottom of the bottle and the underside of the cups being adapted to receive the top of the bottle, with or without bottle cap. The total height of a bottle and the diameter of the bottle top, however, varies with bottles with or without cap. Considering this, the tray, e.g. the cap must have a corresponding shape. The result is that a stack with bottles with trays in between, must be strapped to ensure stability during handling and transportation. This is the case whether all bottles are with or without caps or the stack as such consists of a mixture of bottles with and without caps.

Figure 2:
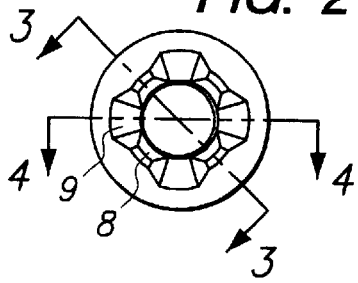
Figure 3:
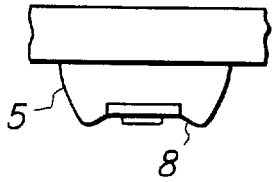
Figure 4:
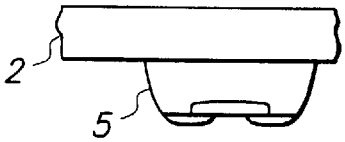
Figure 5:
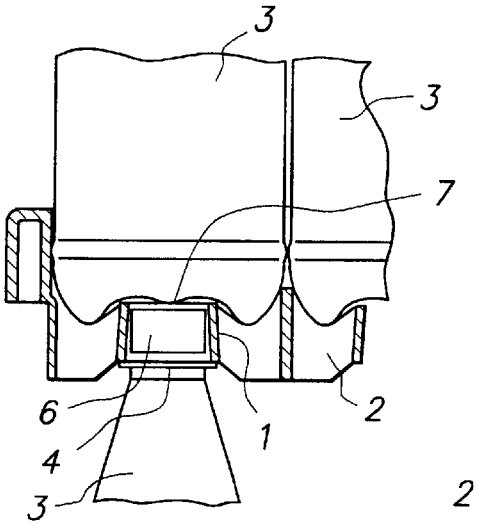
Figure 6:
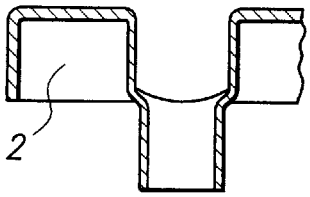
Figure 7:
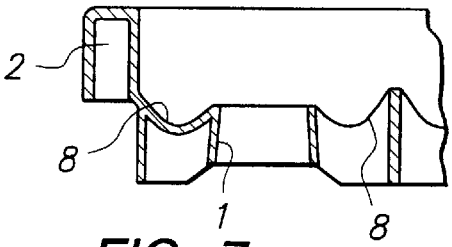

The above mentioned disadvantages and other problems with existing systems, are avoid by the device according to the present invention as defined with the features stated in the claims. In the drawing, FIG. 1 discloses a vertical section of a bottle between an upper and lower tray, FIG. 2 discloses a ground view of a tray cap, FIGS. 3 and 4 disclose respectively sections III and IV in FIG. 2. FIG. 5 discloses a vertical section of a tray between to bottles stacked upon each other, of another embodiment of the tray according to the present invention, FIG. 6 and 7 disclose sections in FIG. 8 and FIG. 8 discloses a ground view of the second embodiment of the present invention.

FIG. 1 discloses part of two trays 2 on top of and below a bottle 3 having cap 6. Trays may be stacked on pallets and secured for transportation to wholesale dealers and retailers.

Figure 8:
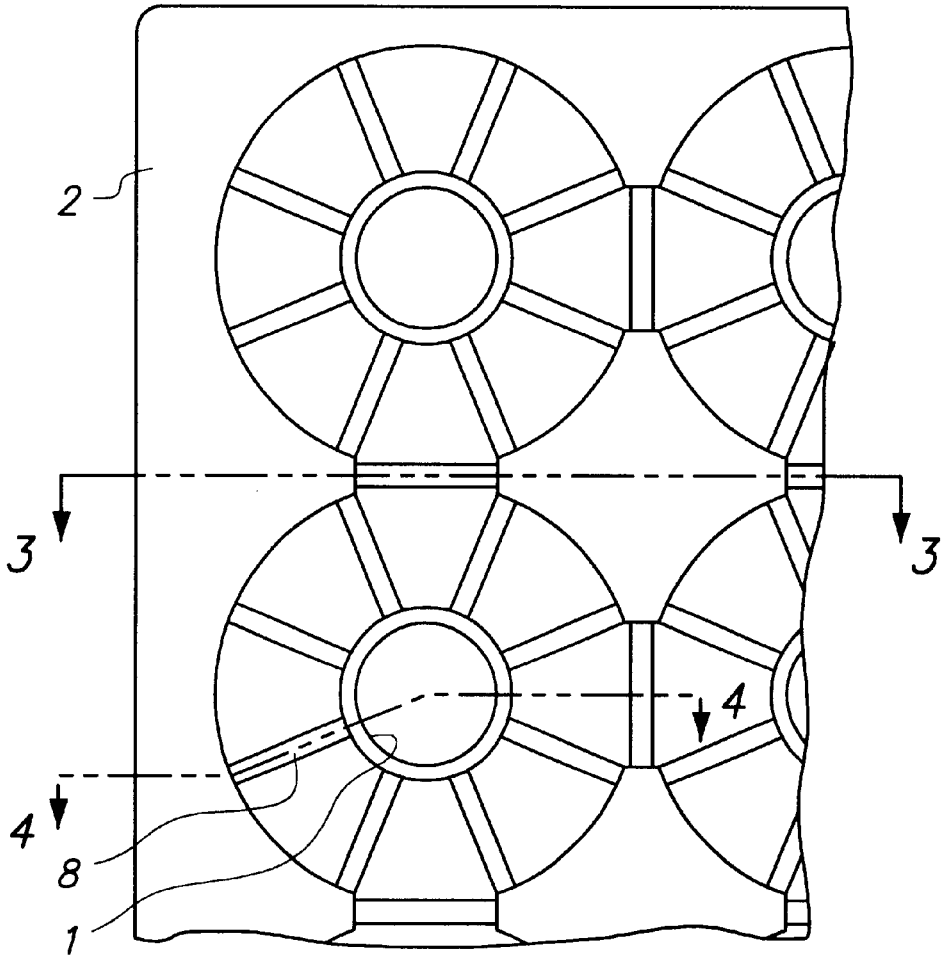

The trace as disclosed in the ground view in FIG. 8, are made preferably of plastics and comprise a pattern of cups 5. Cups 5 may comprise ribs 9 between beads 8. A bottle 3 thereby can be arranged as disclosed in FIG. 1, standing on the ribs 9. The bottle below receives the underside of a trade 2 on the cap 6, the middle of the cup 5 thereby being such that there is a distance from the middle of the cup 5 to the peg 7 resulting from the bottle production.

FIGS. 5–8 disclose another embodiment of the present invention, where the tray 2 can rest directly on a pallet or on bottles 3 below, ring flanges 1 thereby standing on the supporter ring 4 of the bottle. The tray cups further comprising ribs 9 on which the bottles 3 are standing. The production peg 7 is allowed to protrude downwardly into the ring flange 1, the height of the ring flange 1 allowing for this, enabling bottles to be placed below with or without caps. Thereby is ensured that the peg 7 from the bottle manufacturing is protected during handling and transportation.

With the tray 2 according to the present invention, is ensured that stacks with bottles having trays 2 in between, are stable, which is significant for handling as well as transportation. Furthermore it is ensured that the stability as is the same independently of the fact that some bottles may comprise caps 6 and some may not.

We claim:

1. Tray (2) adapted to rest on bottles (3) and also to receive bottles (3) in cups (5) in the upper side of the tray, several trays (2) being adapted to be stacked with intermediate trays (2), CHARACTERIZED IN each cup (5) comprising a central flange ring (1) having a vertical flange, the lower edge of which being adapted to rest on the supporter ring (4) on a bottle (3) standing on a lower tray (2), in such a way that the weight of the tray (2) above, including bottles, is transferred to the bottles standing in a lower tray (2) and further to this tray (2) through the supporter ring (4).

2. Tray according to preceding claim, CHARACTERIZED IN the cups (5) being shaped as ribs (9) extending from the flange ring (1) to the circumference of the cup (5).

* * * * *